United States Patent [19]

Everest

[11] 4,424,636

[45] Jan. 10, 1984

[54] BUCKLE FASTENER, NOTABLY FOR SPORTS FOOTWEAR

[75] Inventor: David C. Everest, Boulder, Colo.

[73] Assignee: Lange International S.A., Fribourg, Switzerland

[21] Appl. No.: 390,838

[22] Filed: Jun. 22, 1982

[51] Int. Cl.[3] ..... A43B 11/00; A43C 11/14; A44B 21/00

[52] U.S. Cl. ..... 36/50; 24/68 SK; 24/69 SK; 24/70 SK

[58] Field of Search ..... 36/50, 117; 24/68 SK, 24/69 SK, 71 SK

[56] References Cited

U.S. PATENT DOCUMENTS

| | | | |
|---|---|---|---|
| 3,182,366 | 5/1965 | Teufel | 24/68 SK |
| 3,204,307 | 9/1965 | Dunn | 36/50 |
| 4,051,611 | 10/1977 | Chalmers | 36/50 |
| 4,142,307 | 3/1979 | Martin | 36/50 |
| 4,193,171 | 3/1980 | Lichowsky | 36/68 SK |

FOREIGN PATENT DOCUMENTS

| | | | |
|---|---|---|---|
| 2844090 | 4/1979 | Fed. Rep. of Germany | 24/71 SK |
| 424538 | 5/1967 | Switzerland | 24/68 SK |

*Primary Examiner*—Werner H. Schroeder
*Assistant Examiner*—Steven N. Meyers
*Attorney, Agent, or Firm*—Robert E. Burns; Emmanuel J. Lobato; Bruce L. Adams

[57] ABSTRACT

This buckle fastener for ski boots or other sports footwear comprises a closing wireform adapted to be tensioned by a latch. The latch is pivoted to the end of an arm having its other end pivoted to one boot portion. In the closed position the latch is locked by a hook cooperating with the pivot pin connecting the arm to the boot. Means are provided on the latch for releasing this hook to open the fastener.

6 Claims, 4 Drawing Figures

BUCKLE FASTENER, NOTABLY FOR SPORTS FOOTWEAR

FIELD OF THE INVENTION

This invention relates to buckle fasteners in general and has specific reference to a device for closing the two lateral portions of a sports footwear, notably a ski boot of which the two lateral flaps have their edges covered by a central portion or tongue, this device comprising essentially a coupling member, for example a wireform, pivotally mounted to a tension lever or latch fulcrumed to one of the boot flaps or like portions.

THE PRIOR ART

A fastener of this type is disclosed in the U.S. Pat. No. 4,051,611. It comprises a latch pivoted to a strap or support fastened to one of the opposed boot flaps; pivoted in turn to this latch is a buckle or wireform adapted to engage one notch of a catch secured to the other flap of the boot. In the particular case of a boot comprising a pair of flaps or lateral portions having their edges covered by a tongue or like central member, the catch and the latch must be fastened to the two boot flaps respectively at two relatively spaced points so that the flaps can be secured by moving them towards each other without allowing the central tongue to interfere with this movement. Therefore, a relatively long coupling member or wireform is required. In the open boot position this relatively long wireform i1 rather cumbersome for it tends to hit or catch the other boot or any other objects in close vicinity of the boot, and thus be damaged.

SUMMARY OF THE INVENTION

Now it is the primary object of this invention to provide an improved buckle fastener of the type set forth hereinabove which permits of increasing the distance between the fixing points of the latch support and the pivotal coupling between the latch and the coupling member without unduly increasing the length of the coupling member. To this end, in the fastener according to the instant invention the latch is pivoted to the end of at least one intermediate arm having its other end pivoted about a pin carried by a support adapted to be secured to one of the boot flaps rearwards of the pivot pin of said latch. In the closed position the pivot pin interconnecting the latch and the arm is thus located above the central portion of the boot. On the other hand, a compass spring mounted to the pivot pin provided between the coupling member and the latch constantly urges the coupling member for engagement with the boot surface, thus reducing the thickness of the device in the open position. The device further comprises means for locking the latch in relation to the pivot pin connecting the intermediate arm to the support secured to the boot, and the latch is provided with means for controlling the release thereof.

According to a specific form of embodiment of the device, a movable hook is pivoted to the latch and responsive to a biasing member constantly urging the latch to its position of engagement in relation to the pivot pin disposed between the arm and its support and thus locking the latch in its closed, fold-down position, the movable hook being provided with an arm adapted to cooperate with an auxiliary arm pivoted to the free end of the latch to constitute an extension of said end and release the hook from the arm pivot pin when the latch is raised by lifting its end consisting of said auxiliary lever. The latch is thus locked by its hook in its closed position.

It is already known from the German Utility Model DE No. 80 02 933 to provide a latch with a hook adapted to engage one notch in the latch support. Now since this notch is located at the end of the curved plate constituting the latch support, this device can only be mounted to a boot portion having a predetermined curvature, in contrast to the device of this invention which provides a support for the arm pivotally connected to the latch which can assume various angular positions without causing any interference with the position of the pivot pin engageable by the latch hook.

According to a preferred form of embodiment, the coupling member consists of a wireform pivotally connected to the latch by means of an axially adjustable member, said wireform being engageable in one of the notches of a rack secured to the other flap of the boot. However, it is possible to invert these component elements by providing a buckle or wireform pivoted to the boot flap opposite the latch, a simple hook or rack being pivoted to the latch for anchoring the buckle or wireform.

In order to afford a clearer understanding of the present invention a preferred form of embodiment thereof will now be described more in detail with reference to the attached drawings.

THE DRAWINGS

DESCRIPTION OF THE PREFERRED EMBODIMENT

Figure 1:
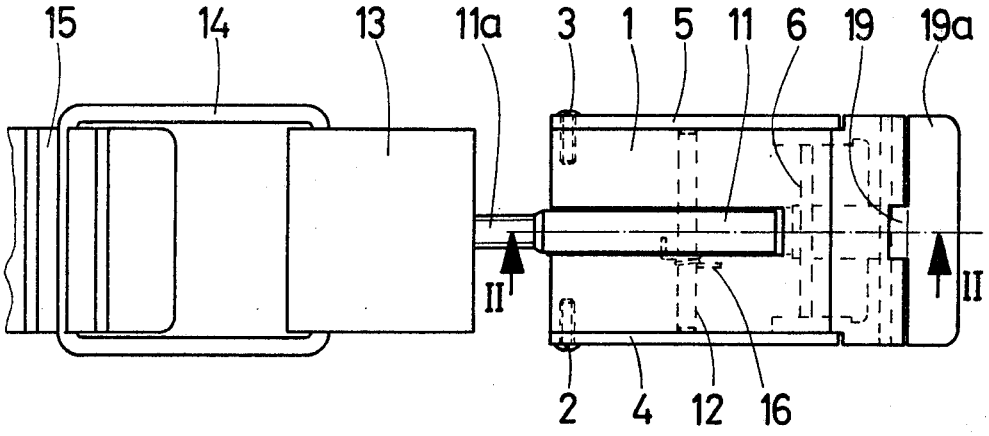
FIG. 1 is a plan view from above of the device.

The fastener illustrated in the drawings comprises a latch 1 pivotally connected by means of pivot pins 2 and 3 to one end of a pair of parallel arms 4,5 having their other ends pivotally connected by means of another pivot pin 6 to the lateral wings of a support 7 secured to one lateral portion 8 of a ski boot comprising another lateral portion 9 and a third portion or tongue 10 covering the registering opposite edges of said lateral portions 8 and 9. The latch 1 is a fork-shaped member having a rod 11 pivotally connected between its prongs about a pivot pin 12. The rod 11 comprises a screw-threaded extension 11*a* engaged by a tapped hole formed in a holder 13 to which a buckle or wireform 14 is pivotally connected, this wireform 14 being adapted to engage one notch of a rack forming catch 15 secured by rivet means to the other lateral portion 9 of the boot. A compass spring 16 mounted about the pin 12 constantly urges the latch 1 and rod 11 towards the boot.

Mounted in a recess formed in latch 1 which has a width corresponding substantially to the distance between the two prongs of latch 1 is a hook 17 pivoted about a pin 18 and provided with an upper arm 17*a* extending towards the adjacent end of latch 1 and bearing against the end of an auxiliary lever 19 fulcrumed about a pin 20 to said adjacent end of latch 1, said auxiliary lever having an integral extension 19*a* engageable by the user's finger for controlling the release of the fastener. Another compass spring 21 is mounted about the pin 18 and its ends bear against the latch 1 and hook 17, respectively, in order to bias this hook 17 against the end of auxiliary lever 19.

Figure 2:
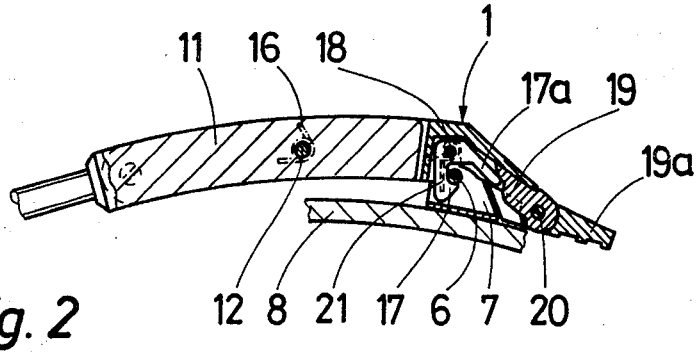
FIG. 2 is a fragmentary section taken along the line II—II of FIG. 1.
Figure 3:
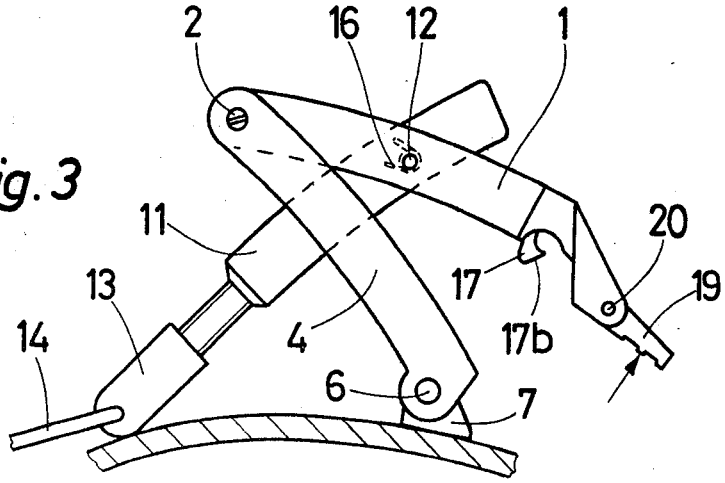
FIG. 3 is a side elevational view showing the device in its open or release position.
Figure 4:
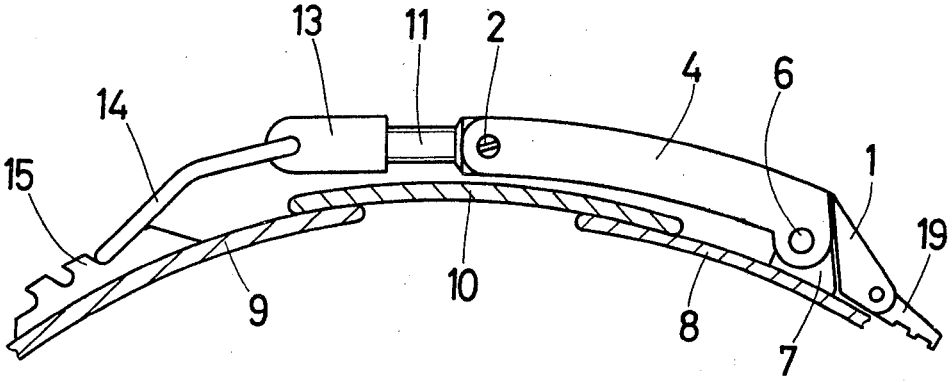
FIG. 4 is a side elevational view showing the complete device mounted to a ski boot comprising three front sections.

In the closed position shown in FIGS. 2 and 4 the hook 17 engages and pivot pin 6 of arms 4 and 5. To open the device, the user lifts the latch by engaging the extension 19*a* of the auxiliary lever, thus causing the hook to pivot and releasing same from pivot pin 6. Thus, the user can open the device as shown in FIG. 3. In this open position the rod 11 of latch 1 is urged against the boot surface by compass spring 16. When the user releases the latch, the end thereof is also caused to engage the boot by the same spring 16. In this position, the device, though open, occupies little space. In all cases, the arms 4 and 5 do not tilt away from the boot (that is, to the right as seen in FIG. 3) and the rod 11, with its wireform 14, is positively prevented from protruding from the boot surface and on the contrary remains in relatively close contact therewith without any risk of hitting other objects and being damaged.

To reclose the device, the wireform 14 is re-engaged into the proper notch of hook 15 and the latch 1 is moved towards the boot surface. During this movement, the cam face 17*b* of hook 17 slides on the surface of pin 6 and the hook 17 is engaged under this pin 6.

It is clearly apparent from FIG. 4 that the pin 2 for pivoting the latch 1 to its support arms 4,5 overlies the central portion 10 of the boot and that the coupling member consisting of rod 11 and wireform 14 is relatively short; in fact, it is obvious that this coupling member would be considerably longer if the latch were fulcrumed about pivot pin 6 as in the case of latches according to the prior art. Moreover, the latch locking action is completely independent of the inclination of support 7 with respect to the latch. The device can be released completely from the central tongue 10 of the boot.

Of course, many modifications and changes may be brought to the buckle fastener according to this invention without departing from the basic principle thereof. Thus, for example, the hook 17 may be adapted to slide instead of pivoting. In this case, it may be released by actuating a push member or any other suitable and known means, for example two movable members mounted on either side of the latch and coupled to a bar rigid with the hook. Besides, the latch and the pivoted arms could be designed differently; for example, the arms could be pivoted inside instead of outside the latch, as shown.

In a modified form of embodiment, the hook 17 could be pivotally mounted to support 7, for example about pivot pin 6, for engagement inside the latch 1. In this case, the hook could be released in the same manner as that illustrated in FIG. 2. In this modified form of embodiment, as in the preceding one, the pivot pin 6 acts both as a pivot means to the arms and as a lock bolt.

What is claimed is:

1. A buckle fastener for closing two portions of a ski boot or like sports footwear, which comprises:

a coupling member adapted to interconnect the two portions of the boot;

means for anchoring a first end of said coupling member to a catch adapted to be secured to one portion of the boot;

a latch pivoted to the end of at least one arm having its other end pivoted about a pin carried by a support adapted to be secured to the other boot portion, a spring mounted about a pivot pin interconnecting said coupling member and said latch constantly urging said coupling member toward the boot surface;

means for locking said latch in relation to the pivot pin interconnecting said arm and said support in the closed position of the device, and an auxiliary control member mounted to said latch for releasing said latch.

2. The buckle fastener of claim 1, wherein said means for locking the latch comprise a movable hook mounted to said latch and urged by spring means to its position of engagement with the pivot pin interconnecting said arm and its support in order to lock the latch in the closed, fold-down position, said hook being provided with an arm adapted to cooperate with an auxiliary lever pivoted to, and constituting an extension of, the free end of said latch in order to release said hook from said pivot pin of said arm when said latch is lifted at its end consisting of said auxiliary lever.

3. The buckle fastener of claim 2, wherein the assembly of said hook and its arm has substantially the shape of an inverted V pivoted about a pin within said latch, one arm of the V cooperating with said auxiliary lever and being urged thereagainst by a compass spring mounted about said hook pivot pin.

4. The buckle fastener of claim 2, wherein said hook end comprises a cam face adapted to slide on the pivot pin of said support and thus move automatically away from said pin when said latch is moved towards the boot surface.

5. The buckle fastener of claim 1, wherein said latch is pivotally mounted between two arms and has a curvature matching that of said arms.

6. A ski boot comprising two lateral portions having their registering edges covered by a third central portion, and at least one buckle fastener interconnecting said lateral portions and bridging said central portion, wherein said buckle fastener comprises a latch pivoted to at least one arm pivoted in turn to a support secured to one of said lateral portions of the boot, a coupling member pivoted to said latch and adapted to engage catch means rigid with the other lateral portion of the boot, said latch being provided with a movable hook responsive to spring means constantly urging said hook to a locking engagement with the pivot pin connecting said latch to said support, an auxiliary lever being mounted to the free end of said latch for releasing said hook from said support pivot pin to open the fastener.

* * * * *